United States Patent [19]

Monteiro

[11] Patent Number: 4,875,931

[45] Date of Patent: Oct. 24, 1989

[54] PARTS TRANSFER SYSTEM HAVING THREE ORTHOGONAL MOVEMENT AXES WHEREIN THE PART LIFTING AND LOWERING MECHANISM MOVING ALONG THE THIRD AXIS IS ACTUATED BY THE MOTION OF THE GRIPPERS IN CLOSING AND OPENING ALONG THE FIRST AXIS

[75] Inventor: Luciano T. S. Monteiro, Sao Caetano do Sul, Brazil

[73] Assignee: Prodty Engenharia E Comercio Ltda, S. Caetano Do Sul, Brazil

[21] Appl. No.: 266,637

[22] PCT Filed: Mar. 18, 1988

[86] PCT No.: PCT/BR88/00004

§ 371 Date: Sep. 8, 1988

§ 102(e) Date: Sep. 8, 1988

[87] PCT Pub. No.: WO88/07419

PCT Pub. Date: Oct. 6, 1988

[30] Foreign Application Priority Data

Mar. 24, 1987 [BR] Brazil ..... PI8701734

[51] Int. Cl.[4] ..... B21J 13/08

[52] U.S. Cl. ..... 72/405; 72/421; 198/621; 414/750

[58] Field of Search ..... 72/405, 421, 422; 198/621; 414/750, 744.3

[56] References Cited

U.S. PATENT DOCUMENTS

| | | | |
|---|---|---|---|
| 3,138,128 | 6/1964 | Suofy | 72/405 |
| 3,754,667 | 8/1973 | Storch | 72/405 |
| 3,760,957 | 9/1973 | Berger | 198/621 |

FOREIGN PATENT DOCUMENTS

| | | | |
|---|---|---|---|
| 481867 | 3/1972 | Australia . | |
| 2847543 | 5/1980 | Fed. Rep. of Germany . | |
| 3040655 | 5/1982 | Fed. Rep. of Germany . | |
| 136775 | 11/1978 | Japan | 72/405 |
| 1230729 | 5/1986 | U.S.S.R. | 72/405 |

OTHER PUBLICATIONS

Soviet Inventions Illustrated, sections P, Q, week 8621, 20 Jul. 1986, (20.07,86), Derwent Publication Ltd., London, p. 71, Su-1 186 532 (Tokarev).

*Primary Examiner*—Daniel C. Crane

*Attorney, Agent, or Firm*—Cushman, Darby & Cushman

[57] ABSTRACT

An improvement in a system for transferring parts between work stations wherein the system has part grippers movable along three orthogonal axes, the first being the opening and closing movements of the grippers, the second being the transfer movement of the grippers between stations and the third being the lifting and lowering movements of the grippers at a station. The improvement resides in the mechanism which effects movements along the first and third axes. This mechanism includes two linearly movable bushings connected with a lost motion and separated by a compression spring with the first bushing being movable by the action of a cam. In their closing movement, the grippers are moved by the bushings until the second bushing is stopped by an abutment. A set of levers is connected between the bushings and the grippers and continued movement of the first bushing while compressing the spring after the second bushing is stopped, transforms the gripping movement of the grippers along the first axis to movement of the grippers along the third axis to lift the part in process. This mechanism, including the grippers, is mounted on a carriage which effects movement of the grippers along the second axis.

5 Claims, 7 Drawing Sheets

PARTS TRANSFER SYSTEM HAVING THREE ORTHOGONAL MOVEMENT AXES WHEREIN THE PART LIFTING AND LOWERING MECHANISM MOVING ALONG THE THIRD AXIS IS ACTUATED BY THE MOTION OF THE GRIPPERS IN CLOSING AND OPENING ALONG THE FIRST AXIS

This invention relates to a part transfer mechanism which uses grippers and the gripper closing and opening motion or first axis movement to actuate the grippers lifting and lowering motion or third axis movement. Several transfer mechanism are known. They are particularly but not exclusively employed with the transfer of parts between several die stations, of a stamping production system, that utilize a two or three axis motion. For the transfer two axis motion, the first axis is the movement of the transfer bars with the grippers thereon towards and away from the parts in process, to hold and release them. The second axis corresponds to the transfer motion or the direct and linear transfer of the part between the several stations. These stations must be aligned with the same distance between them. The parts grippers are mounted on two parallel bars and properly spaced. The adequate control of these movements, results in the proper two axis transfer motion FIG. 1 shows this motion.

The efficiency of this two axis transfer system, is compromised by the need of adequate part configuration and stability to remain on top of die stations, and also without incurring any die interference between the stations.

To solve these restrictions there has been developed the three axis transfer system, this third axis corresponding to a lift motion of the parts in process before the transfer to the subsequent station, and the part lowering inside any cavity after the transfer forward travel. This lift and lowering motion avoids interferences with the dies and also permits a better parts holding condition.

However the mechanism or other systems that produce this third axis movement, are normally complex and expensive. With the the purpose to have a low cost and reliable mechanism there was developed the present "improvement in a parts transfer system, having three orthogonal movement axes wherein the part lifting and lowering mechanism moving along the third axis is actuated by the motion of the grippers in closing and opening along the first axis" movement, in which the moving action of this third axis movement or lifting axis, is obtained with a simple mechanism of levers actuated by the motion of the second movement or grippers closing and opening action. Despite the simplicity of the mechanisms, it assures a precise orthogonal motion (parts lifting and lowering). This condition is very important and many times is fundamental for the three axis movement production system.

The application shown here, see FIG. 4, is of stamping process system with five stations. However the system permits the application to a different number of stations, or applied to other processes, that have a characteristic of several aligned stations, such as, some milling and assembly operations.

In order to provide a better understanding, there follows a brief description of the drawings. Because the present mechanism is activated by the gripper closing motion of a two axis transfer, a description of this type of transfer mechanism is made by reference to the disclosure in a Brazilian patent No. PI 8701725 which had initially a protocol number SP 004.355, by the same holder of this application.

Figure 1:
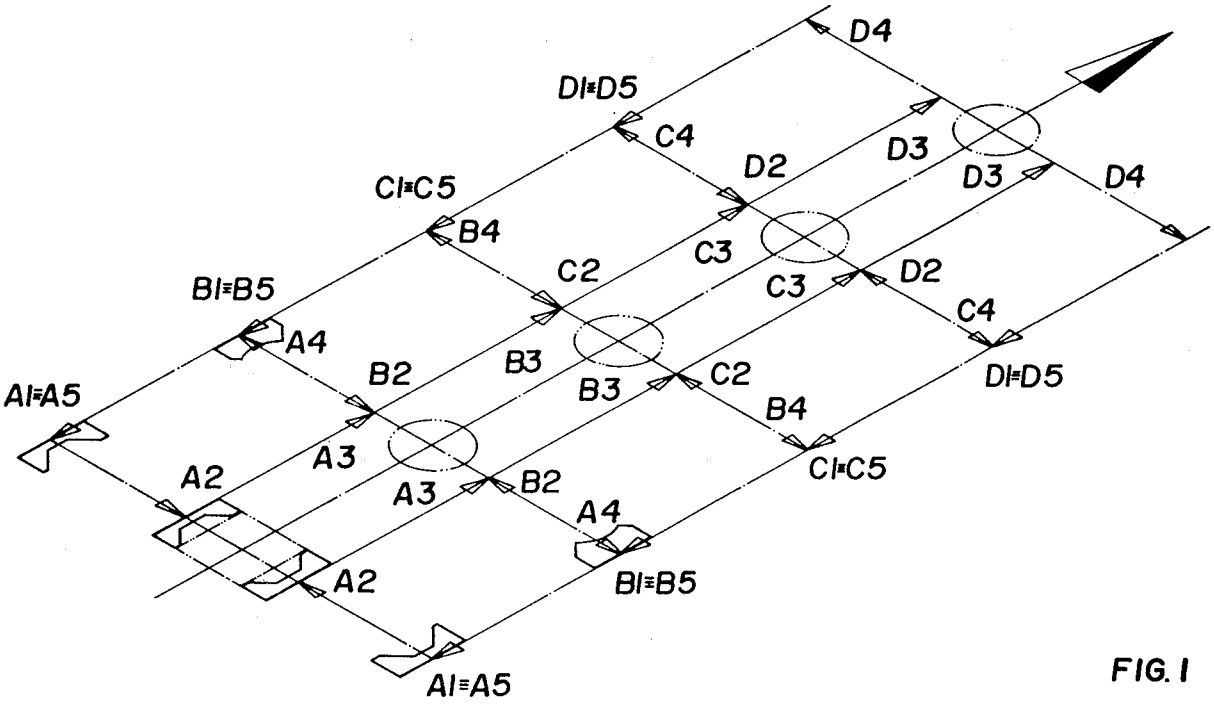
FIG. 1 shows the basic motions of a two axis transfer system.

The object of the present invention is an "improvement in a parts transfer system having three orthogonal movement axes wherein the part lifting and lowering mechanism moving along the third axis is actuated by the motion of the grippers in closing and opening along the first axis". The system includes a linear cam 11 that has a vertical (ascending/descending) motion activated by any means. As shown in this case, that means is a mechanical engagement with a top die platter (now shown), or could be a specific driver such as pneumatic, hydraulic or any other type. The linear cam 11 has an internal groove 13 with an appropriate configuration for each necessary distance of travel of the grippers 59, 60 for the parts 90. The vertical motion of the cam 11 moves a cam follower pin 15 toward the center line of the transfer line of travel of the parts 90 in process. The pin 15 is on one end of a lever 17 having thereon an actuating rod 19 interposed between abutments on a bushing 21 sliding on a rod 23 toward and away from the transfer center line. Up to this point the bushing travel is a typical motion of a two-axis transfer system, and sometimes there is used a direct actuator of any type for the bushing 21 with an adequate control.

The continuance of the linear movement of the bushing 21 toward the parts 90 being processed and the resultant orthogonal (vertical) closing motion of the part grippers 59, 60 is the innovative concept for the transfer system embodying this invention.

The bushing 21 is linked to another bushing 25 through a limiting screw 27. One end of the screw 27 is secured by a nut to a plate 29 on the bushing 25 with the screw extending slidably through a plate 31 on the bushing 21 toward the head of the screw. Between these two plates 29 and 31 there is a compression spring 33. The movement of bushing 25 toward the parts 90 occurs jointly with bushing 21 up to the point where the bushing 25 contacts an abutment 35 joined to the rod support 37. At this point, the bushing 25 stops. However, the bushing 21 at this point starts to compress the spring 33 and so decelerates, briefly stops and accelerates and continues to travel to the limit determined by the forward movement of the lever 17.

To these bushings 25 and 21 are respectively mounted lever supports 39, 41 to which are pivotally attached a set of levers 61, 63 and 79, the concept and design of which results in transferring the motion of bushing 21 orthogonally to the bar 43 to which grippers 59 are attached. The bar 43 is carried by a support 45 to which are pivotally attached ends of the levers 61, 63. The other end of lever 79 is pivotally attached to the mid-length of lever 61.

The pivotal axes 47, 49 and 51 of the levers 61, 79 are located in such a way that the centers form a right angle. The axis 53 is located and mounted exactly at the mid-point between the axes 47 and 51. The lever 61 connects the axes 47 and 51 and the lever 79 connects the axis 49 that is the vertex of the right angle 47, 49, 51 and the axis 53 that is the mid-point between the axes 47 and 51.

The levers 61, 63 and supports 41, 45 form a parallelogram linkage that has its axes 47, 55 aligned in a straight line passing through the axis 49.

This geometric configuration assures that the horizontal travel of bushing 21 be transmited exactly perpendicularly to the gripper bar 43.

The simplicity of this mechanism and the fact that it substitutes a specific actuator for the third axis, represents not only a innovative factor, but also a cost advantage for the parts transfer systems.

A pair of part grippers 59 and 60 is used for each station (process or idle). These part grippers 59 and 60 are properly attached to the gripper bar 43 attending the proper hold, lifting and unloading of the parts 90 in process. The mechanism conception assures the perfect gripping by the grippers and transfering of the parts from station to station.

After a part in process 90 have been lifted from the die 91, and this occurring conjunctly in all stations, there starts the part transfer travel between the stations. This path corresponds to the second axis of the two axis transfer system, and there are several mechanisms or ways to execute it.

In order to complete the transfer cycle description, reference is made to the aforementioned Brazilian Patent No. PI 8701725.

Figure 6:
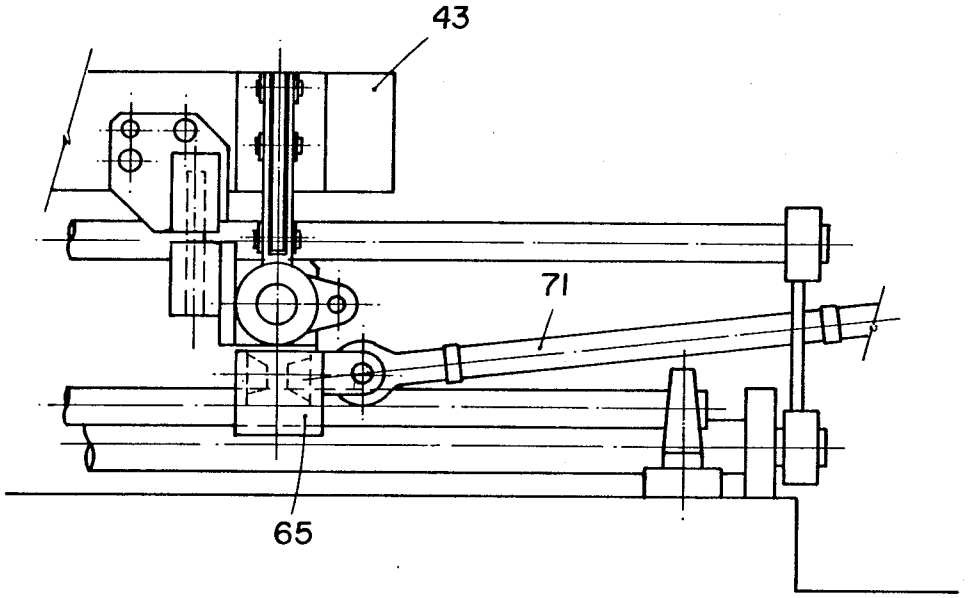
FIG. 6 is a fragmentary side view corresponding to a portion of FIG. 4 showing the mechanism for the forward transfer motion of the parts between stations.

All the part grippers and actuating mechanism therefor described above are mounted on a base carriage 65 that is slidable along fixed carriage rails 67, 69 and moved in reciprocation by the pull and push action of a shaft 71 (FIG. 6) which is driven by an auxiliary drive system.

Figure 2:
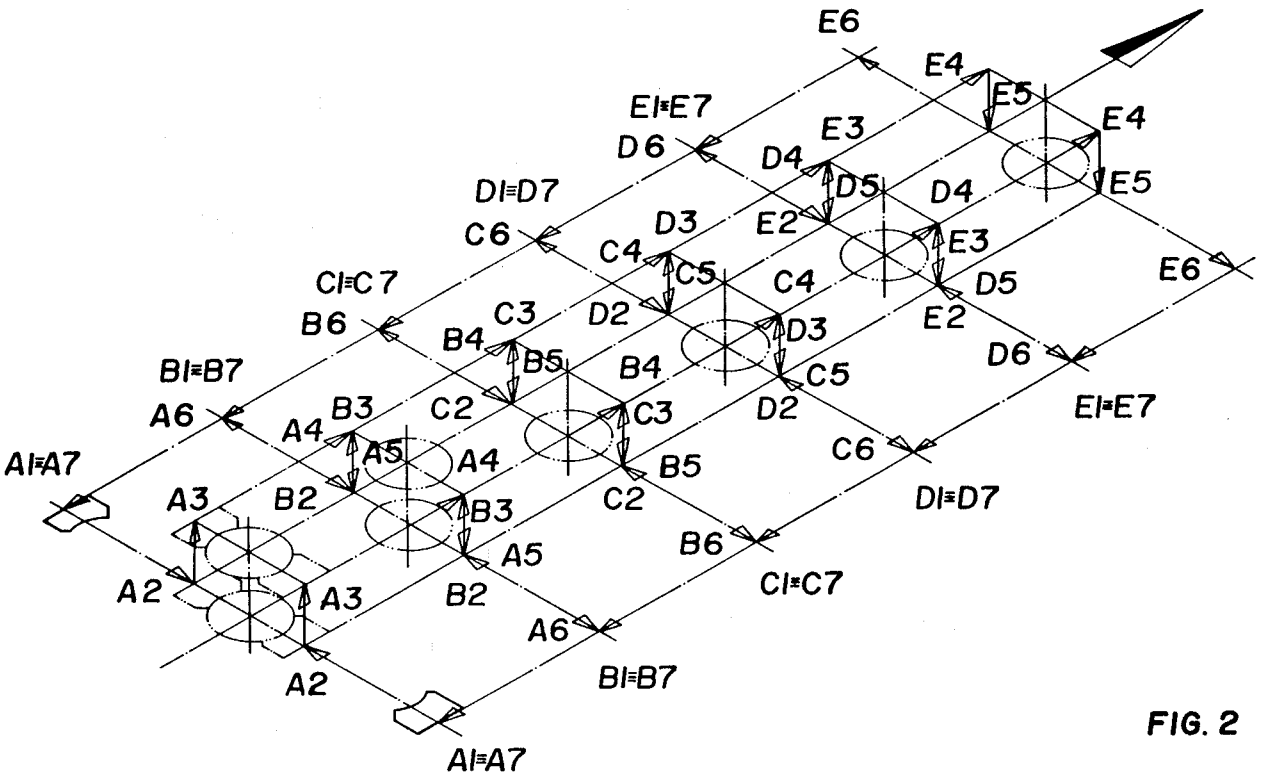
FIG. 2 shows the basic motions of a three axis transfer system.
Figure 3:
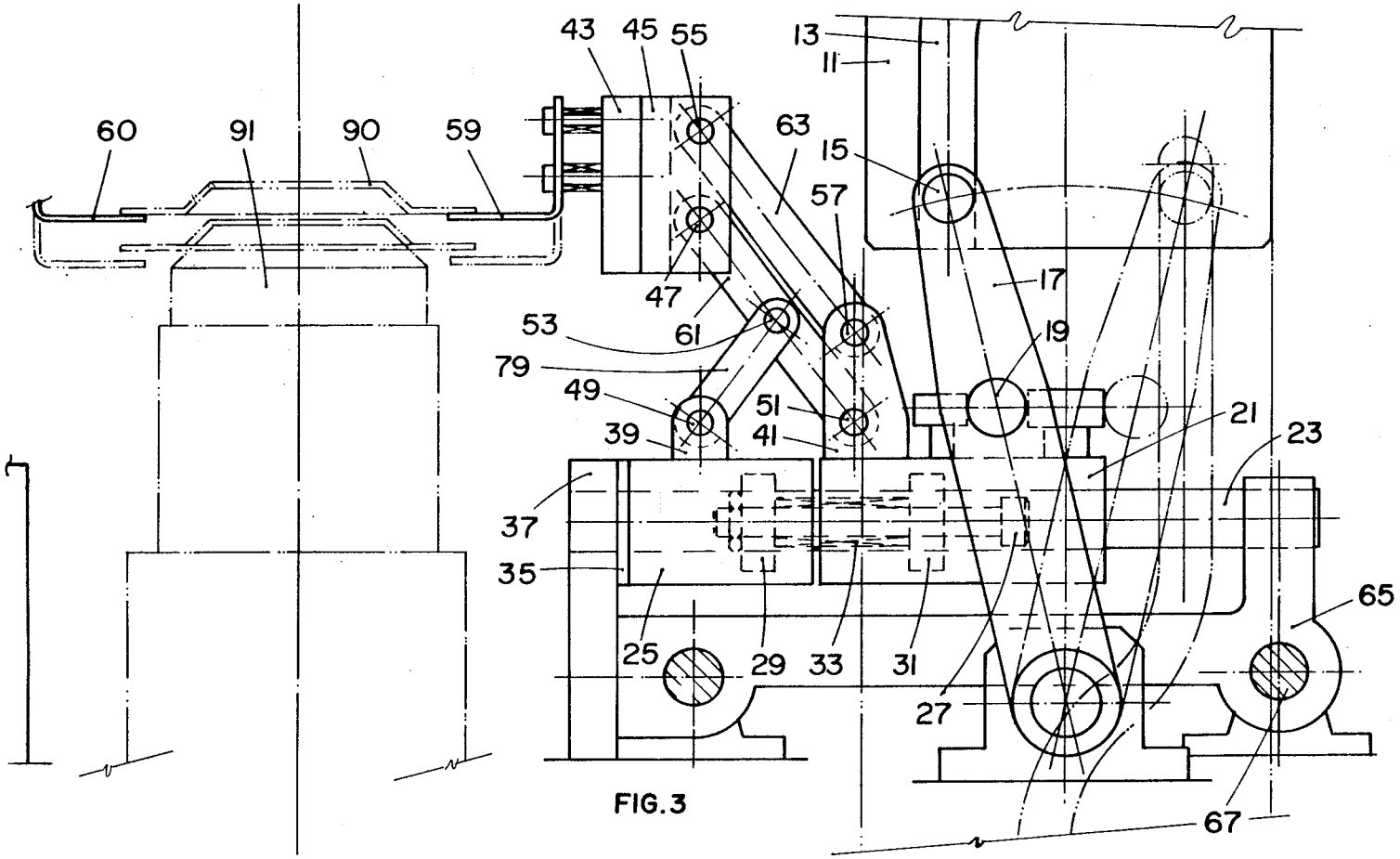
FIG. 3 is an end view of one side of the mechanism embodying this invention and partially the opposite side because this is similar and simetric in relation to the transfer center line.
Figure 4:
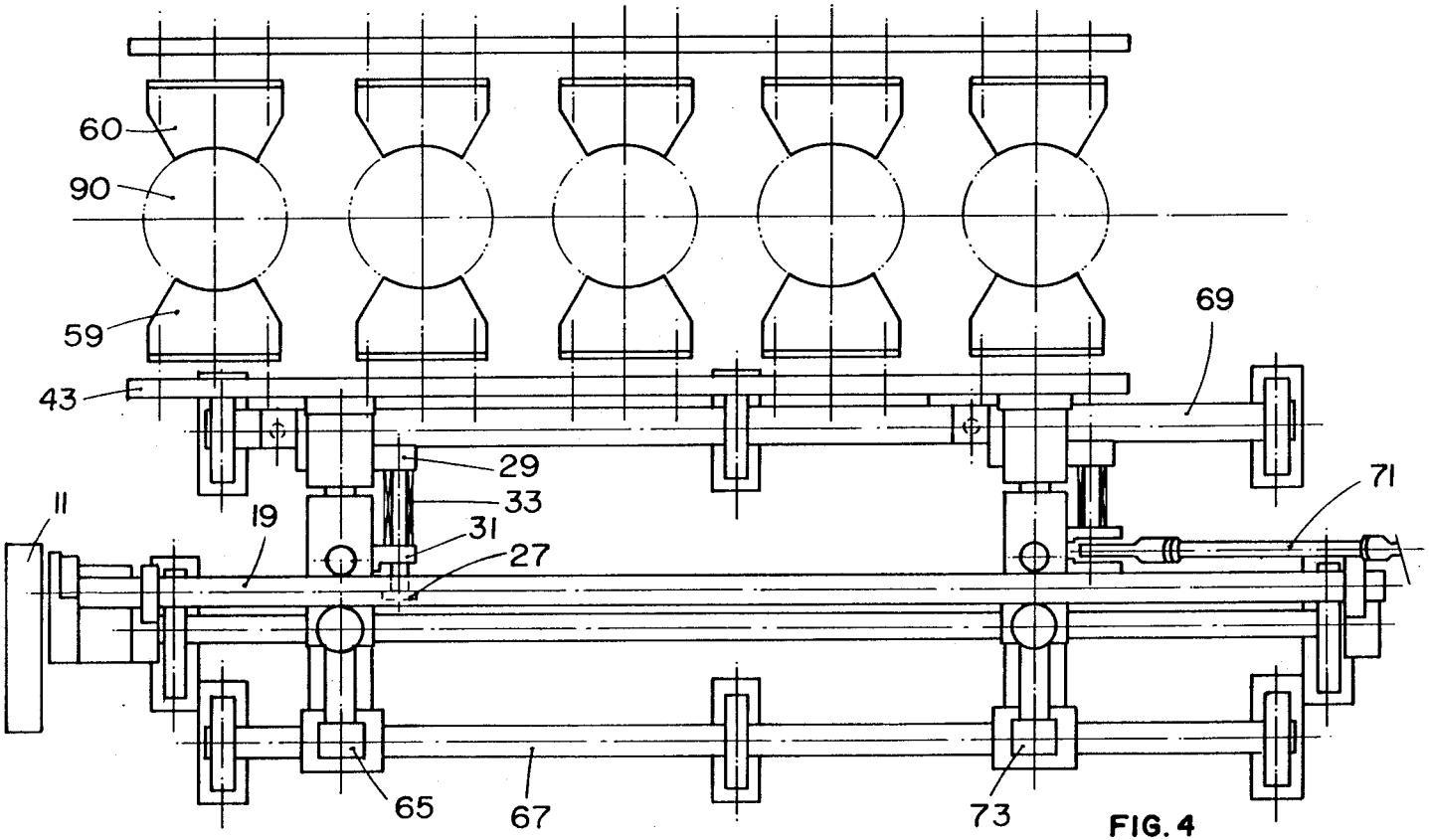
FIG. 4 is a top view of transfer mechanism, showing only one side, the other side being symmetric to the center line.
Figure 5:
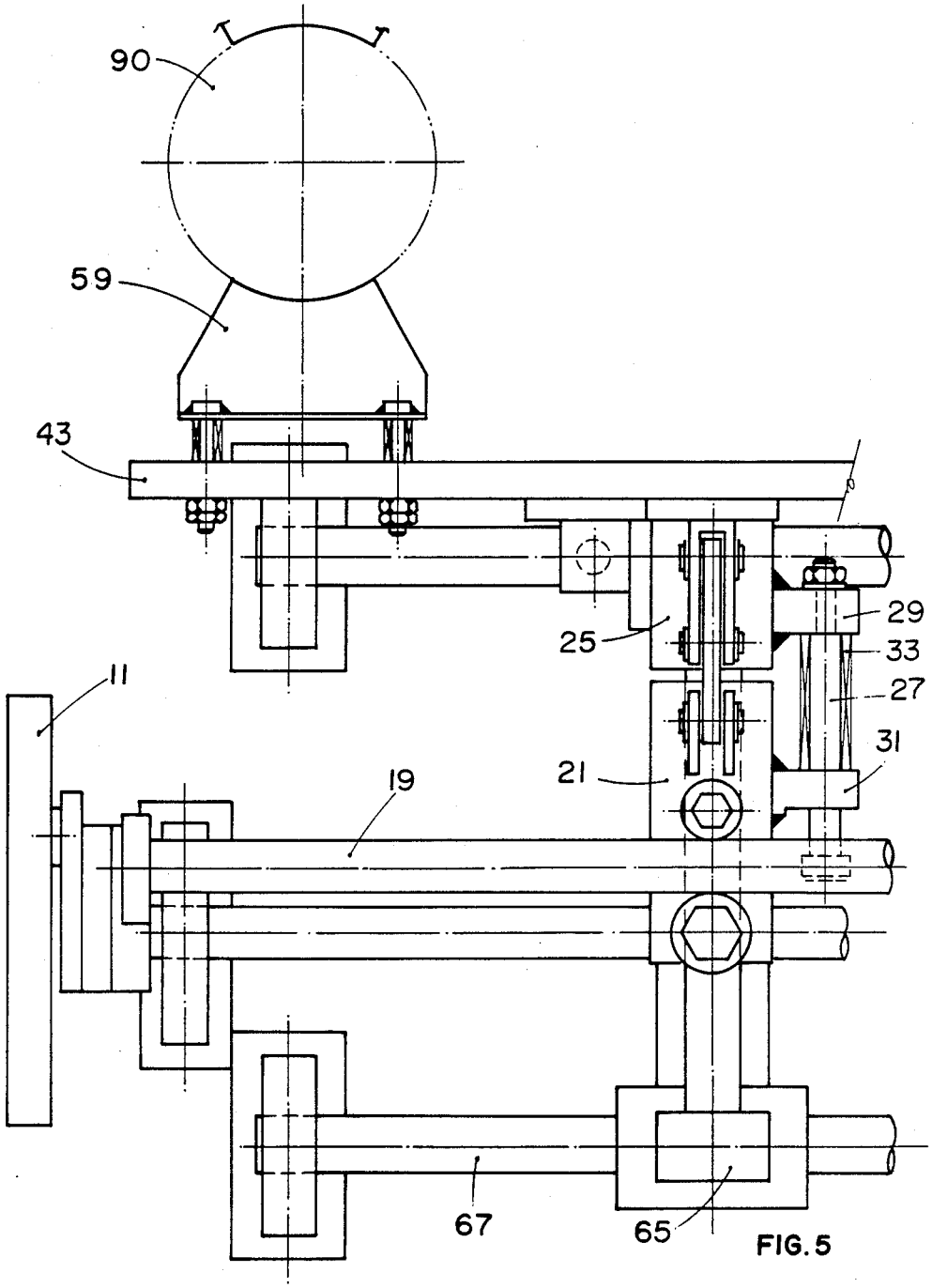
FIG. 5 is an enlarged fragmentary view of a portion of FIG. 4 that shows the lifting mechanism.

The motion and travel coordination of the base carriage 65 must occur in such a way that the end of its forward travel will correspond to the position of a subsequent station, or stop A4, B4 . . . of FIG. 2. At this point there starts the mechanism reverse cycle, completing the transfer cycle. This can occur immediately or with an idle time. The transfer return motion starts with reverse motion of the cam 11.

The returning of lever 17 results also in the returning of bushing 21 and the support 41 but because of the action of the spring 33 the bushing 25 will remain stopped, resulting in the movement of levers 61, 63 and 79 and consequently the lowering of grippers 59 and also the part in process 90 which is loaded on top of the subsequent station or die. The descent of grippers 59 continues until the plate 31 reaches the head of limiting screw 27. After this point, which corresponds to positions A5, B5 . . . (FIG. 2), the bushing 25 returns jointly with bushing 21 until the end of this travel, which corresponds to the positions A6, B6 . . . (FIG. 2). At this position or near it, there starts the return of base carriage 65 to the starting position, that is, point A7, B7 . . . that coincide with points A1, A2 of FIG. 2. The transfer cycle is completed in this way.

Figure 7:
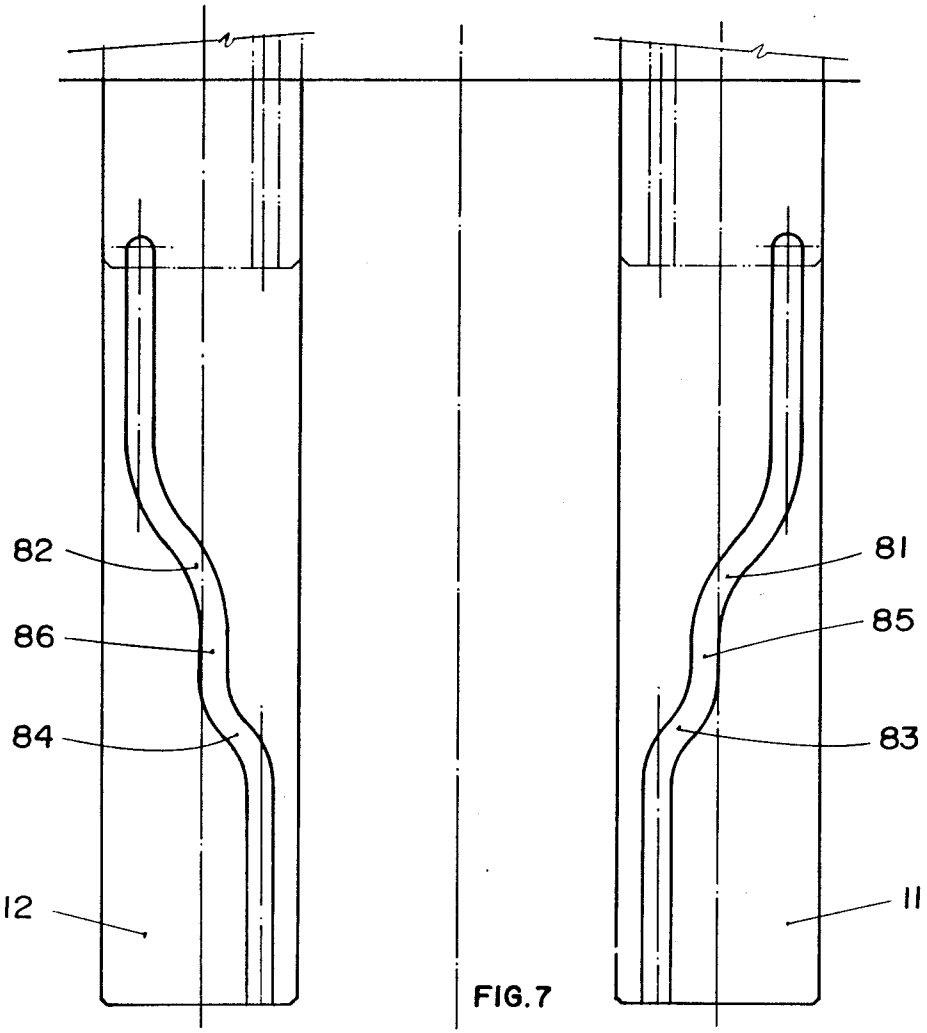
FIG. 7 is a view of the two cams, one for each side of the gripper transfer mechanism, that activates the gripper motion on one side, showing the detail of the cam grooves that effect the acceleration/deceleration motion.

FIG. 7 shows the design of the configuration of the linear cam 11 and the cam 12 on the opposite side. An important and innovative aspect of this configuration and the resulting motion is the characterstic of each cam groove that has two curves and a straight segment between them. The first curve 81, and that 82 on the opposite side, which effects the grippers movement towards a part that occurs with the travel of bushing 25 and also the other bushing at the opposite side (not shown). At the end of the curve 81 and 82 in downward direction, starts a straight segment that results in a short stoppage of the transfer motion. Then starts the second curve 83 and 84 that effects the lifting of the bar 43 and at the same time the bar in the opposite side (not shown). This stopping position between the curves corresponds to the points A2, B2 . . . and A5, B5 . . . of FIG. 2.

At these points it is very important that the transfer system operates as smoothly as possible. For this reason the curves 81, 82, 83 and 84 have the configurtion of a developed cycloid that results in a good acceleration, deceleration motion. The straight segments 85 and 86 also permit a better adjustment of the part lifting points. This curved configuration is of fundamental importance for transfer speeds.

Above and below the curves are straight segments that maintain the grippers in gripping engagement during lifting, lowering and transferring movements of the parts.

In order to have a better parts sustaining and handling, the transfer system has two base carriages 65, 73 which are similar and mounted in parallel. The carriages 65, 73 are connected by the gripper bar 43. Another substantially identical set of mechanisms similar to this is mounted on the opposite side of the transfer center line. Some specific parts processing permit or require only one side of a transfer mechanism. In this case the grippers are unilateral and use a jaw type gripper.

The grippers 59 have different configurations to match with those of the parts. There also are some parts that need a little spring pressure to hold them. These springs are used just in one side of the grippers, i.e. between them and the gripper bar. When this is necessary, the straight cam segments 85, 86 are different in order to have a delay for the travel of the grippers for that side that has the spring.

The gripper bar 43 can be a set of two.

What is claimed is:

1. In a system for transferring parts between work stations and having part gripper means movable along three orthogonal axes, the first being the opening and closing movement of the gripper means, the second being the transfer movement of the gripper means between stations, and the third being the lifting and lowering movement of the gripper means at a station, the improvement comprising:

mechanism connected to said gripper means for effecting opening and closing movements thereof along said first axis and lifting and lowering movements thereof along said third axis, including:

cam-driven first part means guided for linear movement;

second part means guided for linear movement with said first part means;

lost-motion means connecting said parts;

means urging said parts to move linearly apart;

stop means for stopping movement of said second part means while said first part means continues to move linearly in a direction to close said gripper means;

lever means connected between said first and second part means and said gripper means to effect cessation of closing movement thereof and effect lifting movement thereof along said third axis while said second part means is stopped and effect lowering movement of said gripper means while said first part means moves in the opposite direction until said second part means moves therewith and then effect opening movement of said gripper means.

2. The system defined in claim 1 including means mounting the mechanism and gripper means for movement along the second axis.

3. The system defined in claim 1 wherein the lever means includes;

two parallel levers pivotally connected to and between the first part means and the gripper means to form a parallelogram linkage; and a third lever pivotally connected to and between the second part means and one of said parallel levers, the pivot axes of said one lever and the axis of the pivot connecting said third lever to said second part means defining a right-angle and the axis of the pivot connecting said third lever to said one lever being at the mid-point between said axes of said one lever.

4. The system defined in claim 1 including cam means for driving the first part means and having a path for a cam follower including a first cycloid curve segment for effecting closing and opening movements of the gripper means with a smooth acceleration/deceleration motion, followed by a straight first straight segment that results in a minimum hesitation between movements of said gripper means along the first and third axes and followed by a second cycloid curve segment for effecting lifting and lowering movements of said gripper means along said third axis.

5. The system defined in claim 1 including second and third straight segments connected respectively to said first and second cycloid curve segments opposite said first straight segment for stopping motion of said gripper means along said first and third axes and maintaining said gripper means in closed position while said gripper means moves along the second axis.

* * * * *